United States Patent [19]

Walters

[11] 4,185,230

[45] Jan. 22, 1980

[54] GAS DISCHARGE DISPLAY PANEL HAVING AN ARRAY OF DISCHARGE CAVITIES AND A SELF SCAN GLOW TRANSFER DEVICE FORMED BY CAVITIES IN THE ARRAY

[75] Inventor: Frank Walters, Bury, England

[73] Assignee: Ferranti Limited, Hollinwood, England

[21] Appl. No.: 860,638

[22] Filed: Dec. 14, 1977

[30] Foreign Application Priority Data

Dec. 18, 1976 [GB] United Kingdom ..... 52969/76

[51] Int. Cl.[2] ..... H05B 37/00; H05B 39/00; H05B 41/00

[52] U.S. Cl. ..... 315/169.4; 340/811; 340/769

[58] Field of Search ..... 315/169 R, 169 TV, 169.4; 340/324 M, 769, 811

[56] References Cited

U.S. PATENT DOCUMENTS

| | | | |
|---|---|---|---|
| 3,735,183 | 5/1973 | Walters | 315/169 TV |
| 3,787,753 | 1/1974 | Walters | 315/169 TV |
| 3,789,265 | 1/1974 | Holz et al. | 315/169 TV |
| 3,989,974 | 11/1976 | Tottori et al. | 315/169 TV |

*Primary Examiner*—Alfred E. Smith
*Assistant Examiner*—Robert E. Wise
*Attorney, Agent, or Firm*—Cameron, Kerkam, Sutton, Stowell & Stowell

[57] ABSTRACT

A gas discharge display panel has a glow transfer device extending along one or both edges of the panel and consisting of a row, or rows, of cavities extra to the display. One electrode of the, or each, transfer device is common to the conductor associated with the display cavities at that coordinate and the other electrode is grouped with others in threes to a transfer conductor so that three-phase addressing of the transfer conductors causes a transfer glow to move along from cavity to cavity. The transfer glow changes the potential of said common conductor to enable discharges to form in the associated display cavities suitably addressed by potentials applied to selected ones of their other conductors. One transfer device can be used for writing and the other, a short time later, for erasing, thereby providing a variable brightness display.

10 Claims, 3 Drawing Figures

GAS DISCHARGE DISPLAY PANEL HAVING AN ARRAY OF DISCHARGE CAVITIES AND A SELF SCAN GLOW TRANSFER DEVICE FORMED BY CAVITIES IN THE ARRAY

This invention relates to gas discharge display panels including an array of cold-cathode direct current discharge devices each of which may be struck or extinguished to produce a display of the required form.

BACKGROUND OF THE INVENTION

It is known from U.S. Pat. No. 3,735,183 to produce a gas discharge panel including a plurality of discharge cells comprising a block of electrically insulating material containing a plurality of gas-filled cavities arranged in a two-coordinate rectangular array, a first set of electrical conductors adjacent one end of the cavities and in contact with the discharge gas each conductor of the set forming first electrodes of those cells associated with a unique value of one coordinate of the array, a plurality of second electrodes each being located adjacent the other end of an individual cavity and in contact with the discharge gas, a plurality of electrically resistive elements each of which is connected to a different second electrode, and a second set of electrical conductors each conductor of the second set interconnecting the resistive element of the cells associated with a unique value of the other coordinate of the array. Such a display device is hereinafter referred to as "of the type described."

One of the limitations of gas discharge display panels of the type described is the relative complexity of the circuitry required to address individual cells of the panel to strike or extinguish discharges therein.

U.S. Pat. No. 3,787,753 concerns a gas discharge display panel of the type described having a glow transfer device including a plurality of pairs of spaced electrodes in a common gas-filled discharge space, one electrode of each of the pairs comprising a conductor of one of said sets and the other electrode of each of the pairs extending parallel to said one electrode, the arrangement being such that sequential energisation of said other electrode of the pairs of electrodes causes a discharge formed between the electrodes of each pair to scan along the glow transfer device by the mechanism of glow transfer and change the potential of each of said one electrodes of the pair of electrodes in turn.

The amount to which the other electrode extends parallel to the conductor forming said one electrode depends on the current which has to pass through the transfer device discharge when striking all of the discharge cells associated with the conductor. In panels used primarily for displaying alphanumeric signals, each of which requires a $7\times5$ array of cells, the panels may be conveniently made in the form of an $N\times7$ or $N\times16$ array of cells, that is, one or two characters high by n(N/6) characters long and one or two blank cells between characters. Several of such panels may be placed side-by-side or end-to-end to provide a larger display area.

It has been found in such a display that where the one electrode of the glow transfer device forms the conductor common to the 7 or 16 cells, the other electrode has only to extend to provide a common area of the same order of magnitude as the area of the conductor adjacent the end of a cavity; and it is an object of this invention to provide a gas discharge display device, including a glow transfer device, of simple construction.

SUMMARY OF THE INVENTION

According to the present invention a gas discharge display panel of the type described includes a glow transfer device extending along a coordinate of the array, the glow transfer device comprising a line of gas-filled cavities in the block of electrically insulating material, the gas being able to communicate between adjacent cavities, a pair of transfer electrodes associated with each cavity in contact with the discharge gas, first transfer electrodes of each pair being electrically connected to individual conductors of the set of first or second conductors extending orthogonally to the line of cavities and second transfer electrodes being connected to other second transfer electrodes of the pairs to form groups of equal numbers, corresponding electrodes of each group being connected to a transfer conductor such that the repetitive energisation of each transfer conductor in turn causes a discharge formed between a pair of electrodes in one cavity to move along the line of cavities by the mechanism of glow transfer, changing the potential of each first transfer electrode in turn to cause striking or extinguishing of discharges in associated cells.

The cavities of the glow transfer device may be of the same dimension and spacing as the cavities of the discharge cells. The first transfer electrodes may be formed by depositing a suitable electrode material on those portion of the conductors adjacent the end of the cavity. The dimensions of the cavities are related to the common electrode area required. If a larger number of display cells are to be controlled the cavity may be elongated in the direction of the associated first or second conductor.

A display panel as defined in the two preceding paragraphs may also include a second glow transfer device extending along the same coordinate of the array as the first, the corresponding first transfer electrodes of each transfer device being connected to the same conductors of the first or second set and the second transfer conductors of each transfer device being energizable independently of those of the other such that glow transfer discharges can be moved along the coordinate of the array and separated in the direction of travel whereby display discharges struck by operation of one glow transfer device may be subsequently extinguished by operation of the other one.

A method of operating a gas discharge display panel having two glow transfer devices as set forth in the preceding paragraph to give a variable brightness display comprises repeatedly striking display discharges by scanning the transfer glow of one transfer device from one end of the panel to the other end and extinguishing said display discharges by scanning the transfer glow of the other transfer device from said one end of the panel to the other after a time interval set to provide a desired average brightness of the display.

A gas discharge display panel having two glow transfer devices are set forth in the last-but-one paragraph may be operated in the so-called "line write-selective erase" mode in which, in each step of the transfer discharge of one transfer device, discharges are struck in all the display cells associated with the first transfer electrode. The other transfer device operate at the same frequency, one or more cells behind, and functions to extinguish the discharges struck, apart from those retained by selectively addressing their coordinate conductors. In this way, the first transfer electrode of each transfer device is dedicated to one function, that is, either an anode or a cathode, and may be formed of materials best suited to its function.

DESCRIPTION OF THE DRAWINGS

Embodiments of the invention will now be described by way of example with reference to the accompanying drawings, in which.

DESCRIPTION OF THE PREFERRED EMBODIMENT

Figure 1:
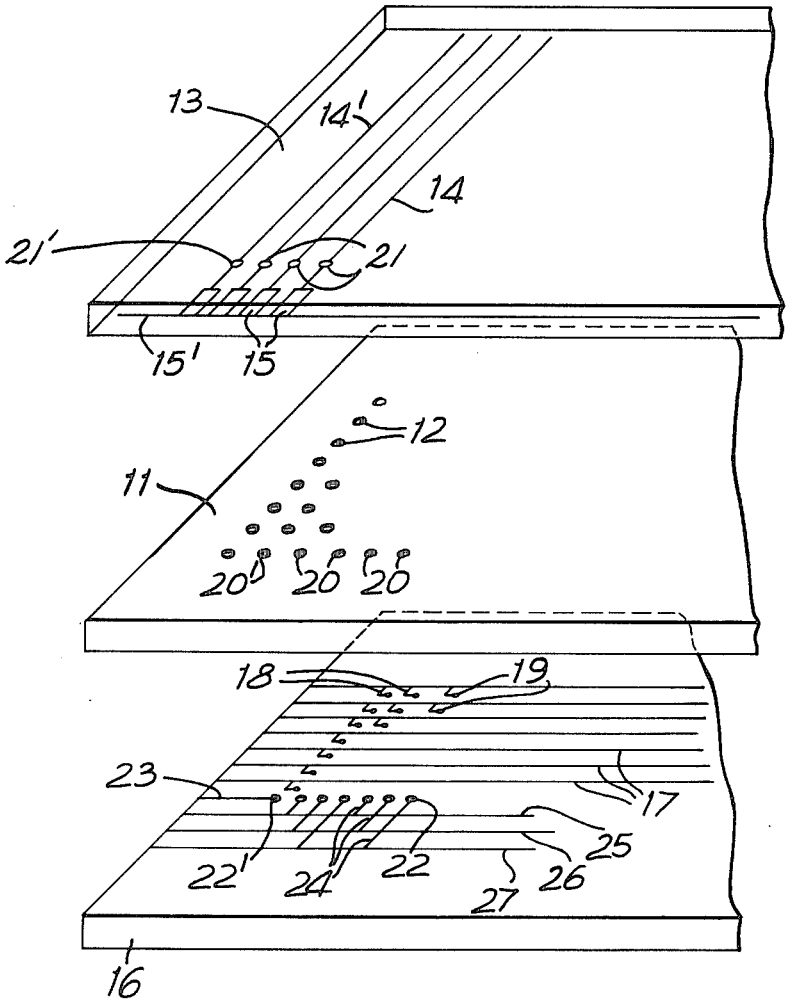
FIG. 1 as an exploded perspective view of a gas discharge display panel according to the present invention.

Referring to FIG. 1 a gas discharge display panel comprises a block 11 of electrically insulating material containing a two-coordinate array of cavities 12 in the form of through apertures. A plate 13 of transparent material, adapted to abut one face of the block 11 and to close off one end of the apertures 12, carries a first set of conductors 14 on the face adjacent the block 11 and arranged such that each conductor overlays the ends of all the apertures extending along one value of one coordinate of the array, for example, columns. The column conductors 14 of the first set are hereafter also called the cathode conductors as the panel will be described with them in this role. Each cathode conductor is connected by way of a resistor 15, also carried by the plate 13, to a common conductor 15'. A plate 16 also of electrically insulating material is adapted to abut the opposite face of the block 11 and to close off the other ends of the apertures. The face of the plate 16 adjacent the block 11 carries a second set of conductors, anode conductors 17, extending orthogonally to the cathode conductors, that is, along rows of the array. To each anode conductor is connected a plurality of resistive elements 18 each contacting an anode electrode 19 cooperating with the end of an aperture of that row. The plates 13 and 16 are sealed to the block 11 around their edges to enclose a discharge gas of suitable composition and pressure, the gas being free to permeate between cavities.

The improved glow transfer device of the present invention comprises a plurality of discharge cells formed by apertures 20 in the block 11 which extend in a row parallel to the anode conductors 17. The apertures 20 are of the same dimensions and spacing as the apertures 12 such that each of the cathode conductors 14 lies over one end of an aperture 20. Each overlying portion of the cathode conductors is plated to provide a first transfer electrode 21 of a pair of electrodes of the glow transfer device. The plate 16 carries a row of second transfer electrodes 22, individual ones of which cooperate with the other ends of the apertures 20. The first discharge cell of the row at which the transfer glow commences, that is, at the left-hand end as seen in FIG. 1, is called a reset cell 20' and the transfer electrode 22' of the reset cell is connected to a unique transfer conductor 23, the reset transfer conductor. The other transfer electrodes 22 are arranged in groups of three, corresponding electrodes of each group being connected by links 24 to one of transfer conductors 25, 26, or 27. The transfer conductors extend parallel to the anode conductors 17 and the links 24 extend parallel to the cathode conductors 14. The cavities of the glow transfer device serve to confine the glow discharge between each pair of electrodes, but the discharge gas is able to communicate between adjacent cells for the purpose of priming on which the mechanism of glow transfer depends.

In operation in a simple "selective write" mode, the conductor 15' is maintained at earth potential and the conductors 17 are all maintained at a potential $V_m$ such that the potential difference across the cavities 12 is sufficient to maintain a discharge struck in any of the cells, but insufficient to cause one to strike. The conductors 25, 26 and 27 are connected to a three-phase pulse source which applies a negative-going pulse to each conductor in turn repetitively. A discharge can be struck in any cell by the application of a voltage across it not less than $V_s$, greater than $V_m$.

To produce a display a negative-going pulse is applied to the reset transfer conductor 23 of such value as to strike a discharge in the reset cell 20'. The effect of the discharge is to apply a negative potential to the electrode 21 taking the potential of the cathode conductor negative by an amount arranged to be $V_p$. If at this time positive-going pulses $V_p$ are applied to selected anode conductors 17, then a voltage of $V_m+2V_p(>V_s)$ will exist across the cells associated with the selected anodes and discharges will be struck in those cells.

In other cells common to these anode conductors 17 the voltage $V_m+V_p$ is insufficient for discharges to strike.

When the pulse is removed from the conductor 23 and a pulse is applied to the conductor 25, a discharge forms in the cell adjacent to that previously containing a discharge, in preference to any others connected to the conductor 25. Simultaneous raising of the potential of selected conductors 17 causes striking of discharges in cells associated with the selected anode conductors and the cathode conductor of the second cell of the glow transfer device. This process is repeated along the transfer device.

To erase a display, the voltage across a cell containing a discharge must be reduced below $V_e$ (where $V_m-2V_p<V_e<V_m-V_p$). The glow transfer device is operated with pulses of opposite polarity, that is, positive-going, such that the potential of the second transfer electrodes 22 is increased by $V_p$ and that of the anode conductors is reduced to $V_m-V_p$. The cells associated with other column conductors of the discharge device are unaffected whereas those associated with the column conductor for which a transfer discharge exists have the voltage across them reduced to $V_m-2V_p$ and are extinguished.

By employing the row of cavities 20 as the discharge space of the glow transfer device, it can be made small in relation to the remainder of the panel.

Figure 2:
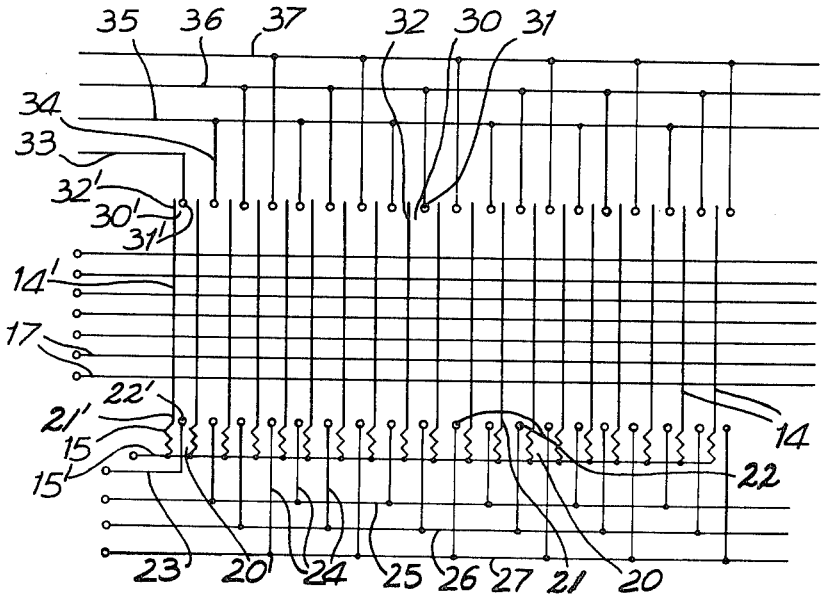
FIG. 2 is a schematic circuit arrangement of a gas discharge display panel having two glow transfer devices.

The number of display cells which can be operated depends on the current passed by the transfer discharge and this in turn depends on the area and efficiency of the electrodes. The area can be increased either by making the cavities 20 of larger diameter or by elongating them in the direction of conductors 14. In either case this involves departing from uniformity of all the cavitities in the block 11. Such a departure may be minimised or avoided by maximising the efficiency of the electrodes by choosing materials best suited to an anode or cathode, as appropriate, and forming a discharge in one sense only. Even where passing a maximum current is not a problem, efficiency and reliability of operation of the glow transfer device may be improved by operating the discharge cells in one sense only. Such operation is achieved by providing a second glow transfer device at the opposite side of the array, and the electrical circuit of such a display panel is shown in FIG. 2. The parts of the second transfer device corresponding to those of the first as described above have reference numbers 10 greater.

The panel may be operated in a "selective write" mode basically as described above. The cells 20 are used as described above to write up a display during a scan of the first glow transfer device. The cells 30 are used as described to erase the display during a scan of the second glow transfer device. The electrodes 22 and 31 are formed of materials best suited for anodes and electrodes 21 and 32 are formed by materials best suited for cathodes. In the "selective write" mode of operation the display may be repeatedly written and erased by operation of both transfer devices at a frequency of, say, 50 scans per second, the time for which the display exists in each scan determining the apparent brightness to a viewer. By altering the spacing between the transfer glows the proportion of scan time existing in the display is variable and so is the average brightness.

Two glow transfer devices operating one after the other may be used to display information by the "line write-selective erase" mode. This mode of operation ensures that every display cell is struck as frequently as the display is changed and avoids problems which may be encountered in striking discharges in cells which have remained unoperated adjacent operated cells for long periods of time.

The anode conductors are all maintained at $V_m$ (where $V_m+2V_p \geqq V_s$) and the common conductor 15' is connected to earth. When a negative-going pulse is applied to reset conductor 23 such that a discharge occurs in reset cell 20' and the current flow in the cell reduces the potential of the cathode conductor 14' to $-V_p$, all the anode conductors 17 have an additional voltage $V_p$ applied such that the voltage appearing across all the cells of the first column is $V_m+2V_p$ $(=V_s)$, and all the cells of that columns strike. All the other cells associated with the anode conductors have a voltage $V_m+V_p$ across and do not strike. When the transfer discharge moves onto the next transfer cell 20 all the cells of the first column remain alight and all discharges are struck in all the cells of the second column. A glow transfer discharge is now started in the reset cell 30' of the second discharge device to move along the transfer device one or two columns behind that of the first transfer device.

The second glow transfer discharge is struck by applying a positive-going pulse to the reset conductor 33 such that the potential of the cathode conductor 14 is raised by $V_p$. Selected anode conductors 17 are simultaneously also lowered in potential by $V_p$ such that the potential difference appearing across them falls to $V_m-2V_p$ $(<V_e)$ and discharges in the associated cells are extinguished. The potential difference across the unselected cells falls to $V_m-V_p$ and the discharges therein are not extinguished. The second transfer discharge steps onto the next cells 30 as the first transfer discharge steps. it will be appreciated that if any of the anode conductors 17 are at $V_m-V_p$ when attempting to strike discharges by operation of the first glow transfer device desired discharges will not be struck in the associated cells. Thus the application of pulses of $\pm V_p$ to the anode conductors must be separated in time. Each of the electrodes of the glow transfer devices is used for only one purpose, that is, either as an anode or a cathode and so that discharge cells can be made and operated with greater long term reliability than is possible with symmetrical cells in which the roles of the electrodes have to be reversed.

If dimming is required on a display panel operated as described in the "line write-selective erase" mode it may be achieved by writing up a complete display and then erasing it by removing the maintaning potential from the anode conductors 17. The display is continuously rewritten and erased to provide average dimming. It will be appreciated that in such operation the part of the display first written will appear brighter than that written last. This effect may be obviated by operating the display panel using bidirectional scanning, that is, the display is written alternately from the left-hand and right-hand sides, and for which reset cells are required at each end of the glow discharge devices.

The arrangement of FIG. 2 may be employed to produce a variable bightness display using the "line write-selective erase" mode where this is preferable to the "selective write" mode, but requires the cells of one glow transfer device to be reversible.

For example, the anode (row) conductors 17 have a potential $V_m$ applied and the common conductor 15 is connected to earth. The row conductors have a pulse $+V_p$ applied simultaneously with the discharge being struck in the cell 20' such as to reduce the potential of the cathode conductor to $-V_p$. Discharges strike in all of the cells of the first column. The anode conductors are returned to potential $V_m$. The potential of selected anode conductors is reduced to $V_m-V_p$ and a pulse of $+V_p$ applied to reset conductor 23 to change the sense of the discharge in cells 20' and the potential of the cathode conductor 24. The cells common to the selected anodes and the cathode conductor are ones not required for the display and discharges therein are extinguished. The transfer glow discharge is stepped to the next cell 20 of the second column and the process is repeated.

At some later time a discharge is struck in the reset cell 30' of the second glow transfer device with a pulse and raising the potential of the first column conductor 14 to $+2V_p$. At a time of the writing cycle when selective erase is achieved by applying a pulse of $-V_p$ to selected cells, all the anode conductors are at $V_m$ or $V_m-V_p$. The potential difference between the anode conductors 17 and first column conductor 14 is thus either $V_m-2V_p$ or $V_m-3V_p$ and any discharges in the cells of that column are extinguished. The transfer discharge steps onto the next device 30 of the second transfer device and erases each column in turn at the same rate as the first transfer device causes each column to be written. The delay between writing and erasing each column of display determines its average brightness.

If it is not possible to apply pulses of $+2V_p$ to the column conductors by way of each transfer discharge without affecting the transfer operation, then before the first transfer device steps a pause is made in which all anode conductors are pulsed to a level of $V_m-V_p$ and a pulse $+V_p$ applied to the cathode conductors.

It will be appreciated from FIG. 2 that in any of the above described modes of operation either glow transfer device may be used for writing or erasing, subject to the choice of electrode materials.

Figure 3:
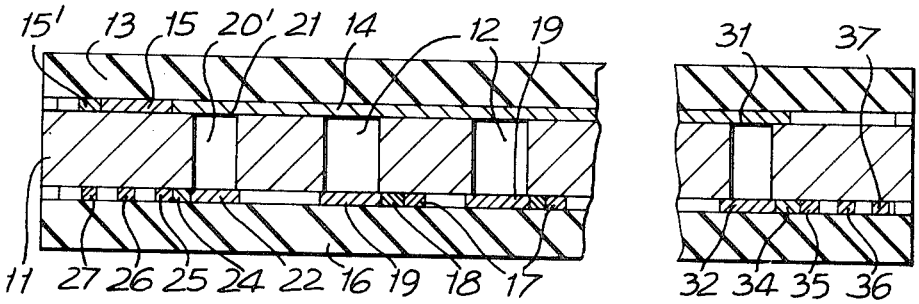
FIG. 3 is a sectional elevation through a display panel having the circuit of FIG. 2.

FIG. 3 shows a cross sectional elevation through a device of FIG. 2 constructed according to the scheme of FIG. 1. Parts common to the other figures are given like reference numerals. This figure illustrates how one or two glow transfer devices may be provided as part of a gas discharge display panel and occupying little more than one extra row of display. On a panel where several displays are arranged side by side to provide several rows of alphanumeric characters then a space is normally left between the rows of characters and this space may be occupied by the glow transfer devices.

It will be appreciated that a display panel according to the invention may be provided with one or two glow transfer devices, or more than three phases, if desired.

Also it will be appreciated that display panel according to the invention may be arranged for connection to other panels to form a larger display; for example, the anode conductors 17 and glow transfer conductors 25, 26, 27, 35, 36, 37 extend to both ends of the panel for connection to an adjacent panel. Provision may also be made for detecting when transfer discharges have reached the end of the panel and providing a signal to initiate some control function, such as striking a fresh transfer discharge. This detection may be achieved by providing a terminal on the final cathode conductor to detect a change in its potential, this change being used as the signal. A reset electrode at the opposite end of the glow transfer device from 23, and described as above for bidirectional scanning, may be coupled by a conductor to the end of the panel adjacent the reset electrode 23 and may have a connection to a conductor corresponding to 23 on the panel mounted adjacently.

What I claim is:

1. A gas discharge display panel including a plurality of discharge cells comprising a block of electrically insulating material containing a plurality of gas-filled cavities arranged in a two-coordinate rectangular array, a first set of electrical conductors adjacent one end of each of the cavities and in contact with the discharge gas, each conductor of the set forming first electrodes of those cells associated with a unique value of one coordinate of the array, a plurality of second electrodes each being located adjacent the other end of an individual cavity and in contact with the discharge gas, a plurality of electrically resistive elements each of which is connected to a different second electrode, a second set of electrical conductors each conductor of the second set inter-connecting the resistive elements of the cells associated with a unique value of the other coordinate of the array, and a glow transfer device extending along a coordinate of the array, wherein the glow transfer device comprises a line of gas-filled cavities in the block of electrically insulating material forming a line of the array, the gas being able to communicate between adjacent cavities, a pair of transfer electrodes associated with each cavity in contact with the discharge gas, first transfer electrodes of each pair being electrically connected to individual conductors of the set of first or second conductors extending orthogonally to the line of cavities and second transfer electrodes being connected to other second transfer electrodes of the pairs to form groups of equal numbers, corresponding electrodes of each group being connected to a transfer conductor such that the repetitive energisation of each transfer conductor in turn causes a discharge formed between a pair of transfer electrodes in one cavity to move along the line of cavities by the mechanism of glow transfer, changing the potential of each first transfer electrode in turn to cause striking or extinguishing of discharges in associated cells.

2. A gas discharge display panel as claimed in claim 1 in which the cavities of the glow transfer device are of the same dimensions and spacing as the cavities of the discharge cells.

3. A gas discharge display panel as claimed in claim 1 in which the first transfer electrodes are formed by depositing a suitable electrode material on those portions of the conductors of said set of first or second conductors adjacent the ends of the cavities.

4. A gas discharge display panel as claimed in claim 1 in which there are three transfer conductors to which said groups of second transfer electrodes are connected.

5. A gas discharge display panel as claimed in claim 1 in which the second transfer electrode associated with each cavity at which a transfer glow commences is connected to a unique transfer conductor.

6. A gas discharge display panel as claimed in claim 1 including a second glow transfer device extending along the same coordinate of the array as the first-named glow transfer device, corresponding first transfer electrodes of each transfer device being connected to the same conductors of said first or second set and the second transfer conductors of each transfer device being energisable independently of those of the other transfer device such that glow transfer discharges can be moved along the coordinate of the array and separated in the direction of travel.

7. A gas discharge display panel as claimed in claim 6 in which the first and second glow transfer devices are electrically identical.

8. A gas discharge display panel including a plurality of discharge cells comprising a block of electrically insulating material containing a plurality of gas-filled cavities arranged in a two-coordinate rectangular array, a first set of electrical conductors adjacent one end of each of the cavities and in contact with the discharge gas, each conductor of the set forming first electrodes of those cells associated with a unique value of one coordinate of the array, a plurality of second electrodes each being located adjacent the other end of an individual cavity and in contact with the discharge gas, a plurality of electrically resistive elements each of which is connected to a different second electrode, a second set of electrical conductors each conductor of the second set interconnecting the resistive elements of the cells associated with a unique value of the other coordinate of the array, and a glow transfer device extending along a coordinate of the array, wherein the glow transfer device comprises a line of gas-filled cavities in the block of electrically insulating material forming a line of the array, the gas being able to communicate between adjacent cavities, a pair of transfer electrodes associated with each cavity in contact with the discharge gas, first transfer electrodes of each pair being electrically connected to individual conductors of the set of first or second conductors extending orthogonally to the line of cavities and second transfer electrodes being connected to other second transfer electrodes of the pairs to form groups of equal numbers, corresponding electrodes of each group being connected to a transfer conductor such that the repetitive energisation of each transfer conductor in turn causes a discharge formed between a pair of transfer electrodes in one cavity to move along the line of cavities by the mechanism of glow transfer, changing the potential of each first transfer electrode in turn to cause striking or extinguishing of discharges in associated cells, and including means for detecting the end of a scan of the glow transfer device.

9. A gas discharge display panel as claimed in claim 6 including a second glow transfer device extending along the same coordinate of the array as the first-named glow transfer device, corresponding first transfer electrodes of each transfer device being connected to the same conductors of said first or second set and the second transfer conductors of each transfer device being energisable independently of those of the other transfer device such that glow transfer discharges can be moved along the coordinate of the array and separated in the direction of travel, and in which the first transfer electrodes of the different glow transfer devices are arranged to function as electrodes of opposite polarity to each other.

10. A method of operating a gas discharge display panel as claimed in claim 9 to provide a variable brightness display comprising repeatedly striking display discharges by scanning the transfer glow of one glow transfer device from one end of the panel to the other and extinguishing said display discharges by scanning the transfer glow of the other glow transfer device from said one end of the panel to the other after a time interval set to provide a desired average brightness of the display.

* * * * *

UNITED STATES PATENT AND TRADEMARK OFFICE

CERTIFICATE OF CORRECTION

PATENT NO. : 4,185,230

DATED : Jan. 22, 1980

INVENTOR(S) : Frank WALTERS

It is certified that error appears in the above-identified patent and that said Letters Patent are hereby corrected as shown below:

Claim 9, line 1, change "6" to -- 8 --.

Signed and Sealed this

*Twentieth* Day of *May 1980*

[SEAL]

*Attest:*

SIDNEY A. DIAMOND

*Attesting Officer*

*Commissioner of Patents and Trademarks*